US005877754A

United States Patent [19]

Keith et al.

[11] Patent Number: 5,877,754

[45] Date of Patent: Mar. 2, 1999

[54] PROCESS, APPARATUS, AND SYSTEM FOR COLOR CONVERSION OF IMAGE SIGNALS

[75] Inventors: Michael Keith, Beaverton; Stephen Wood, Hillsboro, both of Oreg.

[73] Assignee: Intel Corporation, Santa Clara, Calif.

[21] Appl. No.: 224,833

[22] Filed: Apr. 8, 1994

Related U.S. Application Data

[63] Continuation-in-part of Ser. No. 78,935, Jun. 16, 1993, Pat. No. 5,384,582.

[51] Int. Cl.[6] ..... G09G 5/06

[52] U.S. Cl. ..... 345/199; 345/154

[58] Field of Search ..... 345/153, 154, 345/155, 199, 147, 149; 348/455, 454

[56] References Cited

U.S. PATENT DOCUMENTS

| | | | |
|---|---|---|---|
| 4,743,959 | 5/1988 | Frederiksen . | |
| 4,775,858 | 10/1988 | Stapleton et al. . | |
| 4,857,992 | 8/1989 | Richards . | |
| 4,933,761 | 6/1990 | Murakami et al. . | |
| 4,953,019 | 8/1990 | Skikakura et al. . | |
| 4,956,638 | 9/1990 | Larky et al. | 345/199 |
| 4,974,071 | 11/1990 | Maeda . | |
| 4,991,122 | 2/1991 | Sanders . | |
| 4,994,911 | 2/1991 | Nakayama et al. . | |
| 5,003,299 | 3/1991 | Batson et al. . | |
| 5,046,071 | 9/1991 | Tanoi . | |
| 5,047,853 | 9/1991 | Hoffert et al. . | |
| 5,065,231 | 11/1991 | Greaves et al. | 345/154 |
| 5,068,644 | 11/1991 | Batson et al. . | |
| 5,091,717 | 2/1992 | Carrie et al. | 345/199 |
| 5,097,330 | 3/1992 | Guichard et al. . | |
| 5,122,877 | 6/1992 | Keesman . | |
| 5,124,688 | 6/1992 | Rumball . | |
| 5,138,303 | 8/1992 | Rupel . | |
| 5,142,273 | 8/1992 | Wobermin . | |
| 5,150,209 | 9/1992 | Baker et al. . | |
| 5,177,608 | 1/1993 | Ohki et al. . | |
| 5,201,030 | 4/1993 | Carrie | 345/149 |
| 5,204,664 | 4/1993 | Hamakawa . | |
| 5,218,431 | 6/1993 | Gleicher et al. . | |
| 5,218,432 | 6/1993 | Wakeland . | |
| 5,220,410 | 6/1993 | Wakeland et al. . | |
| 5,233,684 | 8/1993 | Ulichney . | |
| 5,241,382 | 8/1993 | Paik et al. . | |
| 5,258,826 | 11/1993 | Wakeland et al. . | |
| 5,311,602 | 5/1994 | Nieglos et al. . | |
| 5,317,397 | 5/1994 | Odaka et al. . | |
| 5,327,254 | 7/1994 | Daher . | |
| 5,329,292 | 7/1994 | Nishioka et al. . | |
| 5,341,442 | 8/1994 | Barrett . | |
| 5,351,085 | 9/1994 | Coelho et al. . | |

(List continued on next page.)

FOREIGN PATENT DOCUMENTS

| | | | |
|---|---|---|---|
| 2130594 | 5/1990 | Japan | 345/154 |
| 3231290 | 10/1991 | Japan | 345/154 |

OTHER PUBLICATIONS

Kronander, "Post– and Pre–Processing in Coding of Image Sequences Using Filters with Motion Compensated History" 1988 Int. Conf. Acoustics, Speech, Sig. Processing, vol. 2, Apr. 1988, pp. 1104–1107.

IBM Technical Disclosure Bulletin, vol. 37, No. 03, Mar. 1994 New York, US, pp. 95–96, XP 000441392 'Direct–to–Palette Dithering.'

IBM Technical Disclosure Bulletin, vol. 33, No. 5, Oct. 1990 New York, US, pp. 200–205, XP 000107434 'Default RGB Color Palette with Simple Conversion from YUV.'

IEEE Transactions on Consumer Electronics, vol. 37, Issue 3, Aug. 1991, pp. 182–189, "Single–Chip Video Processing System," by Hans–Jürgen Désor.

*Primary Examiner*—Xiao Wu

*Attorney, Agent, or Firm*—William H. Murray

[57] ABSTRACT

A process, apparatus, and system for generating and using lookup tables to convert image signals from a multi-component format to a single-index CLUT format for an arbitrary CLUT palette. In a preferred embodiment, lookup tables are generated for an arbitrary CLUT palette and used to convert (with Y, U, and V dithering) three-component subsampled YUV9 video signals to 8-bit CLUT signals.

36 Claims, 6 Drawing Sheets

U.S. PATENT DOCUMENTS 5,371,515 12/1994 Wells et al. ..... 345/149
5,377,051 12/1994 Lane et al. .
5,379,376 1/1995 Bednowitz ..... 345/154
5,381,145 1/1995 Allen et al. .
5,381,180 1/1995 Keith .
5,384,582 1/1995 Keith et al. .
5,389,949 2/1995 Nakada et al. ..... 345/154
5,402,181 3/1995 Jenison ..... 345/199
5,406,310 4/1995 Aschenbrenner et al. .
5,416,614 5/1995 Crawford .
5,428,465 6/1995 Kanamori et al. .
5,428,720 6/1995 Adams, Jr. .
5,430,465 7/1995 Sabella et al. .
5,450,098 9/1995 Oz .
5,455,600 10/1995 Friedman et al. ..... 345/199
5,479,189 12/1995 Chesavage et al. ..... 345/199

PROCESS, APPARATUS, AND SYSTEM FOR COLOR CONVERSION OF IMAGE SIGNALS

CROSS-REFERENCES TO RELATED APPLICATIONS

This is a continuation-in-part of application Ser. No. 08/078,935, filed on Jun. 16, 1993, now U.S. Pat. No. 5,384,582 which is incorporated herein by reference in its entirety.

BACKGROUND OF THE INVENTION

1. Field of the Invention

The present invention relates to digital image signal processing, and, in particular, to computer-implemented processes, apparatuses, and systems for color converting digital image signals.

2. Description of the Related Art

Conventional systems for displaying video images in a PC environment are limited, in part, by the processing capabilities of the PC processors. These limitations include low video frame rates and small video window sizes for display of video images. Such limitations result in low video quality. As a result, some conventional systems for playing video in a PC environment require additional hardware that is designed to process video signals at the rates needed to provide acceptable video quality.

It is desirable to provide a video decoding system for displaying high-quality, full-motion digital video images on a graphics display monitor in a personal computer (PC) environment that does not require any additional hardware. Such a decoding system is preferably capable of performing decoding, conversion, and display functions to support a video playback mode. In playback mode, the decoding system accesses encoded video signals from a mass storage device, decodes the signals into a multi-component (e.g., subsampled three-component YUV9) video format, converts the multi-component signals to single-index color lookup table (CLUT) signals, and uses the CLUT signals to generate displays for a display monitor.

It is also desirable to provide a video encoding system for generating the encoded video signals that will be decoded and displayed by the video decoding system. Such an encoding system is preferably capable of performing capture, encoding, decoding, conversion, and display functions to support both a compression mode and the playback mode. In compression mode, the encoding system captures and encodes video images generated by a video generator, such as a video camera, VCR, or laser disc player. The encoded video signals may then be stored to a mass storage device, such as a hard drive or, ultimately, a CD-ROM. At the same time, the encoded video signals may also be decoded, converted, and displayed on a display monitor to monitor the compression-mode processing.

Conventional means for converting three-component video signals to single-index CLUT signals in video processing (i.e., encoding or decoding or both) systems typically define some or all of the palette colors of the finite CLUT that is used to display the video images. There are, however, computer application programs (for use in PC-based video processing systems) that also define the CLUT palette. What is needed is color conversion means for converting three-component video signals to single-index CLUT signals in a video processing system, where the color conversion means uses an arbitrary pre-defined CLUT palette, such as the CLUT palette defined by a computer application program running on the video processing system.

It is accordingly an object of this invention to overcome the disadvantages and drawbacks of the conventional art and to provide a video decoding system for displaying high-quality, full-motion video images in a PC environment.

It is a further object of this invention to provide a video encoding system for generating the encoded video signals to be decoded, converted, and displayed by the video decoding system.

It is a particular object of the present invention to provide efficient color conversion of three-component image signals to single-index CLUT signals for use in generating displays on a display monitor.

It is a further particular object of the present invention to provide means for converting three-component video signals to single-index CLUT signals using an arbitrary pre-defined CLUT palette.

Further objects and advantages of this invention will become apparent from the detailed description of a preferred embodiment which follows.

SUMMARY OF THE INVENTION

The present invention is a computer-implemented process, apparatus, and system for displaying an image. The system has a CLUT palette, which maps each CLUT signal $C_h$ of a plurality of CLUT signals C to a corresponding display signal $d_h$ of a plurality of display signals D. According to a preferred embodiment of the present invention, a color conversion table is generated for the CLUT palette. The color conversion table maps each image signal $s_i$ of a plurality of image signals S to a corresponding CLUT signal $c_i$ of the plurality of CLUT signals C. An image signal $s_j$ corresponding to an image is provided. The image signal $s_j$ is transformed to a CLUT signal $c_j$ of the plurality of CLUT signals C using the color conversion table. The image is displayed in accordance with the CLUT signal $c_j$, wherein the CLUT signal $c_j$ is transformed to a display signal $d_j$ of the plurality of display signals D using the CLUT palette.

BRIEF DESCRIPTION OF THE DRAWINGS

Other objects, features, and advantages of the present invention will become more fully apparent from the following detailed description of a preferred embodiment, the appended claims, and the accompanying drawings in which:

DESCRIPTION OF PREFERRED EMBODIMENT(S)

Description of Video System

Figure 1:
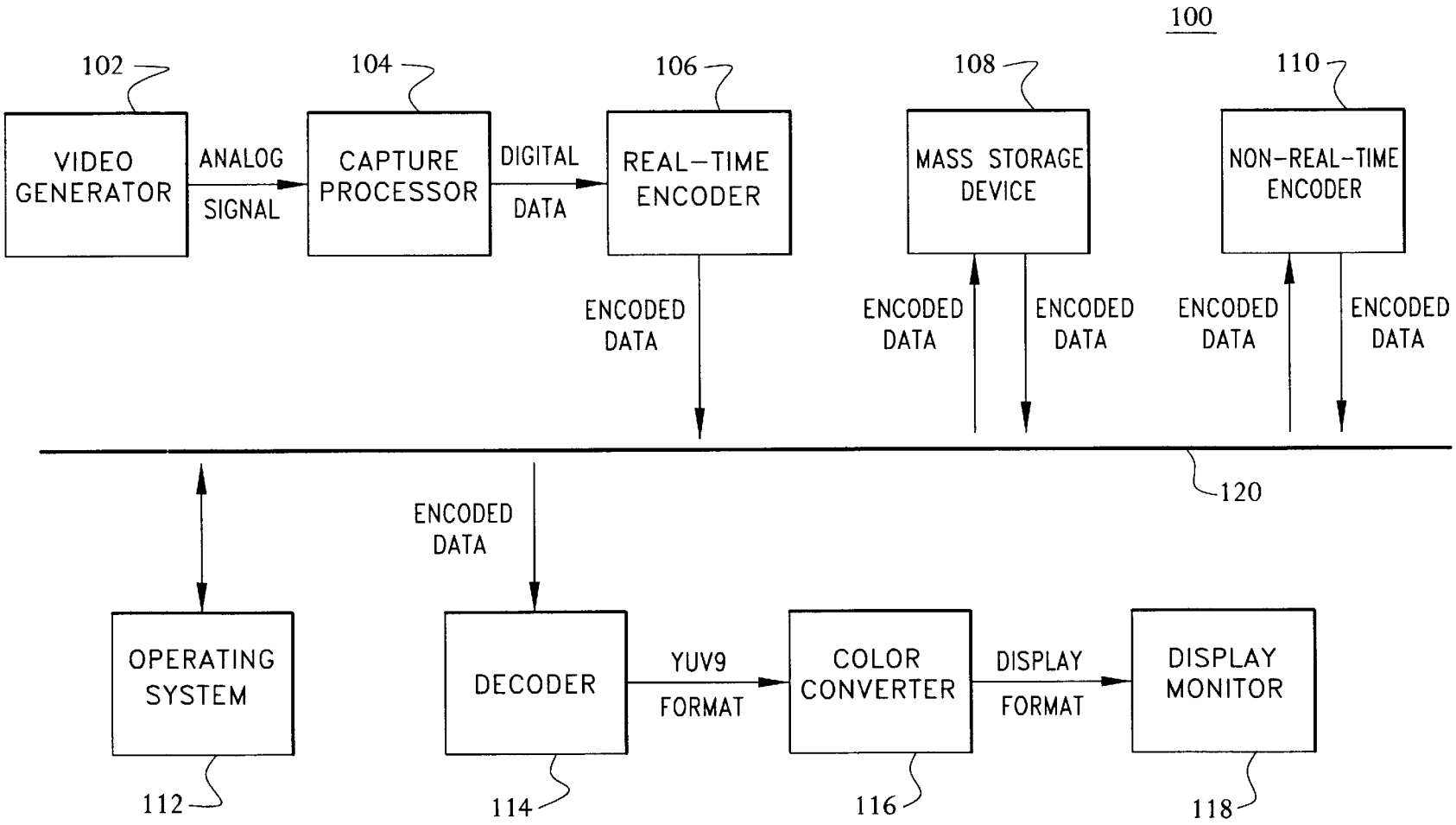
FIG. 1 is a block diagram of a video system for displaying video images in a PC environment, according to a preferred embodiment of the present invention.

Referring to FIG. 1, there is shown a block diagram of a video system 100 for displaying video images in a PC environment, according to a preferred embodiment of the present invention. Video system 100 is capable of performing in the compression and playback modes. The operations of video system 100 are controlled by operating system 112 which communicates with the other processing engines of video system 100 via system bus 120.

When video system 100 operates in compression mode, video generator 102 of video system 100 generates analog video signals and transmits those signals to capture processor 104. Capture processor 104 decodes (i.e., separates) the analog video signal into three linear components (one luminance component Y and two chrominance components U and V), digitizes each component, and scales the digitized signals. Scaling of the digitized signals preferably includes subsampling the U and V signals to generate digitized video signals in subsampled YUV9 format. Those skilled in the art will understand that YUV9 signals have one U-component signal and one V-component signal for every (4×4) block of Y-component signals.

Real-time encoder 106 encodes (i.e., compresses) each component of the captured (i.e., unencoded or uncompressed) YUV9 signals separately and transmits the encoded signals via system bus 120 for storage to mass storage device 108.

The encoded signals may then be optionally further encoded by non-real-time encoder 110. If such further encoding is selected, then non-real-time encoder 110 accesses the encoded signals stored in mass storage device 108, encodes the signals further, and transmits the further encoded video signals back to mass storage device 108. The output of non-real-time encoder 110 is further encoded digital video signals.

Video system 100 also provides optional monitoring of the compression-mode processing. If such monitoring is selected, then, in addition to being stored to mass storage device 108, the encoded signals (generated by either real-time encoder 106 or non-real-time encoder 110) are decoded (i.e., decompressed) back to YUV9 format (and scaled for display) by decoder 114. Color converter 116 then converts the decoded, scaled YUV9 signals to a display format selected for displaying the video images on display monitor 118. For the present invention, the display format is preferably selected to be 8-bit CLUT format, although alternative embodiments of the present invention may support additional or alternative CLUT display formats.

When video system 100 operates in the playback mode, decoder 114 accesses encoded video signals stored in mass storage device 108 and decodes and scales the encoded signals back to decoded YUV9 format. Color converter 116 then converts the decoded, scaled YUV9 signals to selected CLUT display format signals for use in generating displays on display monitor 118.

In a preferred embodiment, operating system 112 is a multi-media operating system, such as, but not limited to, Microsoft® Video for Windows or Apple® QuickTime, running on a personal computer with a general-purpose host processor, such as, but not limited to, an Intel® x86 or Motorola® microprocessor. An Intel® x86 processor may be an Intel® 386, 486, or Pentium® processor. Video generator 102 may be any source of analog video signals, such as a video camera, VCR, or laser disc player. Capture processor 104 and real-time encoder 106 are preferably implemented by a video co-processor such as an Intel® i750 encoding engine on an Intel® Smart Video Board. Non-real-time encoder 110 is preferably implemented in software running on the host processor.

Mass storage device 108 may be any suitable device for storing digital signals, such as a hard drive or a CD-ROM. Those skilled in the art will understand that video system 100 may have more than one mass storage device 108. For example, video system 100 may have a hard drive for encoded signals generated during compression mode and a CD-ROM for storing other encoded signals for playback mode.

Decoder 114 and color converter 116 are preferably implemented in software running on the host processor. Display monitor 118 may be any suitable device for displaying video images and is preferably a graphics monitor such as a VGA monitor.

Those skilled in the art will understand that each of the functional processors of video system 100 depicted in FIG. 1 may be implemented by any other suitable hardware/software processing engine.

Description of Conversion of YUV9 Signals to CLUT Signals

Video system 100 preferably supports the use of an 8-bit color lookup table (CLUT) that may contain up to 256 different colors for displaying pixels on display monitor 118 of FIG. 1. Each CLUT color corresponds to a triplet of YUV components. Previous approaches to the conversion of three-component YUV9 signals to single-index CLUT signals relied upon specific predefined palettes, which the operating systems were programmed to use. Under the present invention, video system 100 is capable of converting YUV9 signals to CLUT signals using an arbitrary predefined CLUT palette. Those skilled in the art will understand that video system 100 is therefore capable of displaying video signals in an environment in which some or all of the palette is defined, for example, by an application running on video system 100.

Video system 100 is capable of generating lookup tables for converting YUV9 signals to CLUT signals for an arbitrary CLUT palette. Video system 100 is also capable of using those lookup tables to convert YUV9 signals to CLUT signals as part of video display processing.

Generation of Lookup Tables

An 8-bit single-index CLUT palette maps each of (up to) 256 8-bit CLUT signals to a color space (e.g., three-component RGB) that is used by a PC operating system (e.g., Microsoft® Windows® operating system) to display images (e.g., video, graphics, text) on a display monitor. Video processing systems may encode and decode video images using color formats other than single-index CLUT signals and three-component RGB signals, such as subsampled YUV9 signals. In order for the operating system to convert video signals from CLUT format to RGB format, the video processing system preferably first converts YUV9 signals to CLUT signals.

Video system 100 of the present invention generates color-conversion lookup tables to map subsampled YUV9 signals into 8-bit CLUT signals for arbitrary pre-defined CLUT palettes. One way to generate such lookup tables is to compare each of the possible YUV9 signals with each of the 256 possible CLUT signals to identify the CLUT signal that is closest to each of the YUV9 signals. This brute force method may be prohibitively expensive (in terms of processing time) in a video system with limited processing bandwidth due both to the number of comparisons involved and to the complexity of each comparison. Each comparison would typically involve the following computation:

$$(y-y_0)^2+(u-u_0)^2+(v-v_0)^2, \quad (1)$$

where (y,u,v) represents a YUV signal and $(y_0,u_0,v_0)$ represents the color in the CLUT palette (converted to YUV format).

In order for video system 100 to convert video signals properly, new color-conversion lookup tables are preferably generated when video system 100 is initialized and each time the CLUT palette changes. The generation of lookup tables is preferably implemented in as short a time period as practicable to avoid significant disruption or delay in the display of video images. The generation of lookup tables is preferably implemented on the host processor of video system 100.

In a preferred embodiment of the present invention, three color-conversion lookup tables are generated: ClutTable, TableU, and TableV. ClutTable is used to convert three-component YUV signals from YUV space to the closest single-index 8-bit CLUT signals in CLUT space. TableU and TableV provide U and V component dithering to improve the quality of the video display.

According to a preferred process for converting YUV9 signals to CLUT signals (described in further detail in the next section of this specification entitled "Color Conversion Processing."), the CLUT signals are generated using 7-bit Y, U, and V component signals in which the Y component signals are constrained between 8 and 120 inclusive. The U and V component signals are also preferably constrained between 8 and 120. The ClutTable lookup table is a 16K lookup table that is accessed with 14-bit indices that are based on 7-bit Y component signals and 3-bit U and V component signals. One of the bits of the 14-bit indices are unused.

Figure 2:
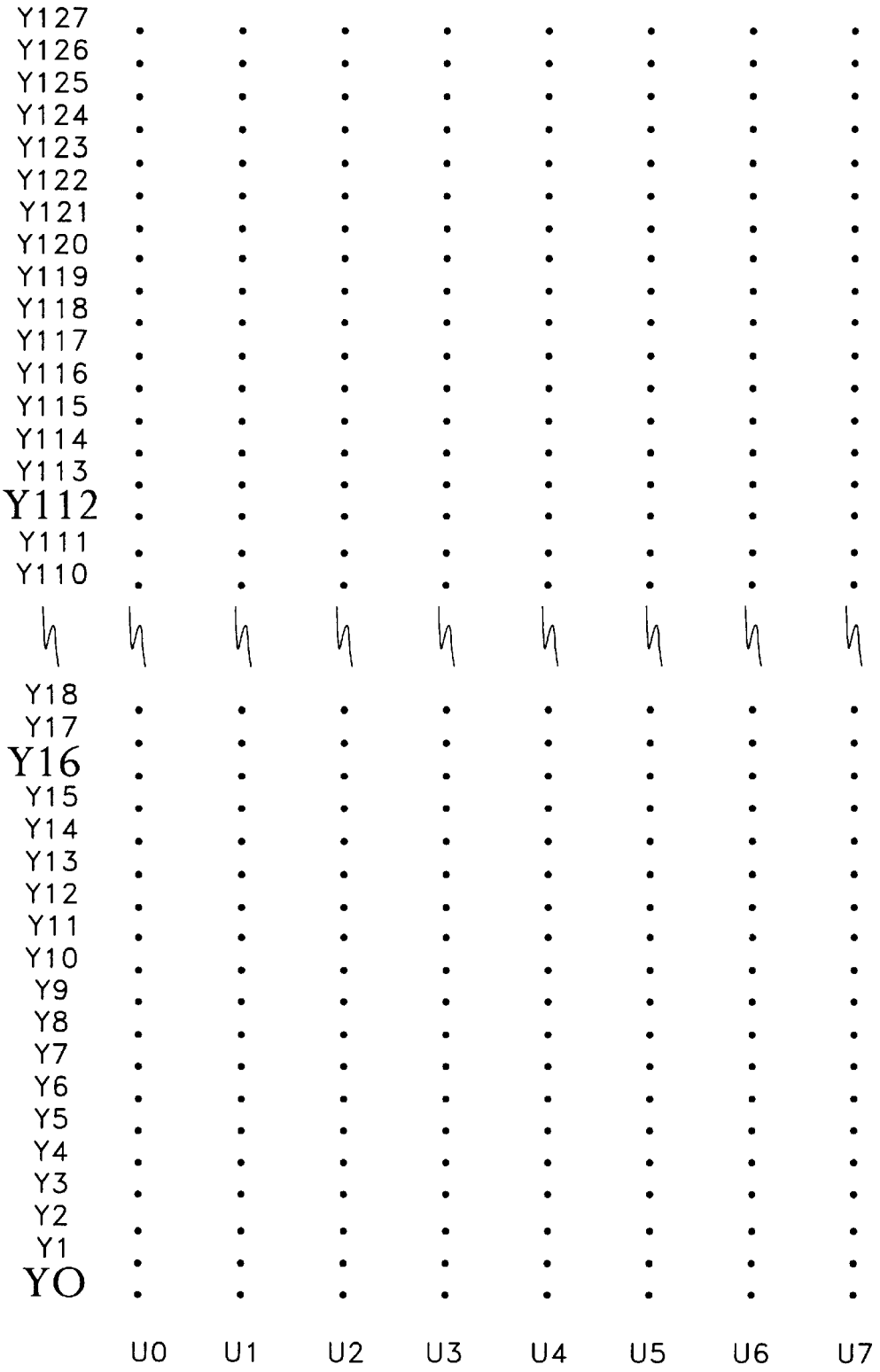
FIG. 2 is a representation of YUV component space.

Referring now to FIG. 2, there is shown a two-dimensional representation of the portion of YUV space for component Vi (one of the eight possible 3-bit V components (V0, V1, . . . , V7)). For component Vi, there are 128 different 7-bit Y components (Y0, Y1, . . . , Y127) and 8 different 3-bit U components (U0, U1, . . . , U7). A fine grid is defined to include all of the possible YUV combinations of the full YUV space. In addition, a coarse grid is defined to include all of the possible YUV combinations of the full YUV space in which Y is an integer multiple of 16. Thus, in FIG. 2, all of the points depicted are part of the fine grid, while only those points having a Y component of one of (Y0, Y16, . . . , Y112) are part of the coarse grid.

The coarse grid divides the YUV space into 8 Y regions. One Y region comprises all of the YUV combinations with Y components between Y0 and Y15 inclusive. Another Y region comprises all of the YUV combinations with Y components between Y16 and Y31 inclusive.

Figure 3:
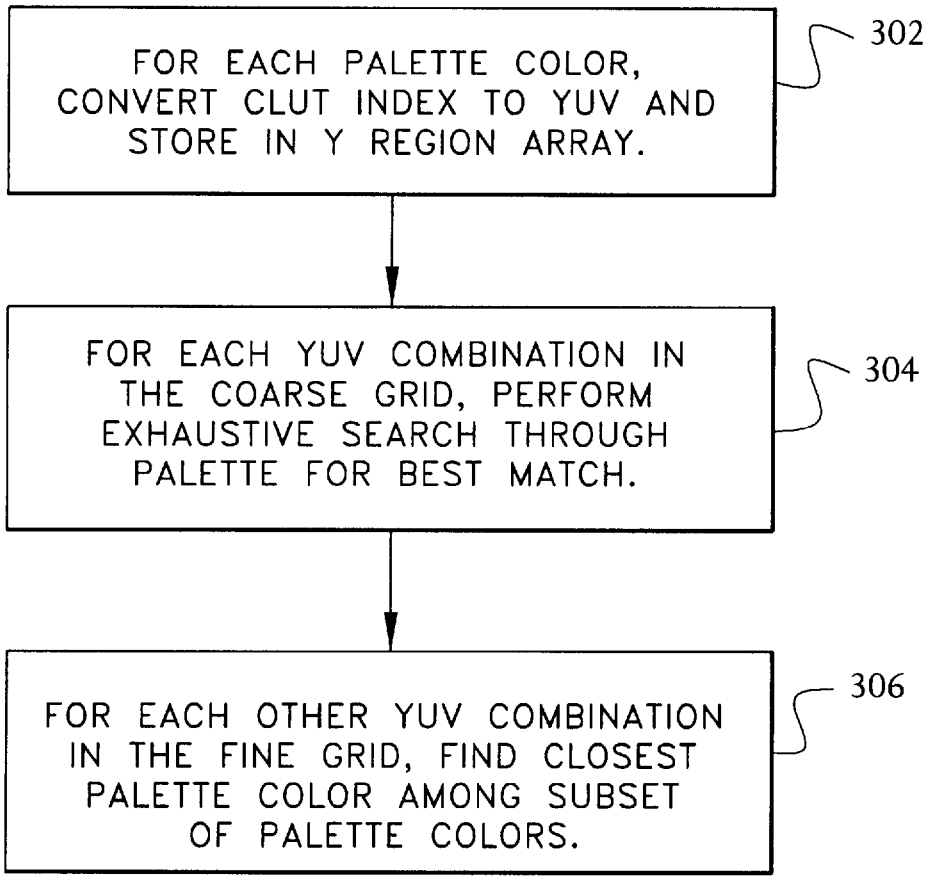
FIG. 3 shows a process flow diagram of preferred processing implemented by the video system of FIG. 1 to generate the lookup tables used in the color-conversion processing of FIG. 6 for an arbitrary CLUT palette.

Referring now to FIG. 3, there is shown a process flow diagram of the processing implemented by video system 100 to generate the ClutTable lookup table for YUV9-to-CLUT color conversion for an arbitrary CLUT palette, according to a preferred embodiment of the present invention.

ClutTable generation begins by converting each of the (up to 256) palette colors into the corresponding YUV components and storing the color in the appropriate location of an array (YRegion[8][256]) that identifies the Y region in which the palette color lies (step 302 of FIG. 3). Those skilled in the art will understand that the palette colors may be distributed in any manner throughout the YUV space and will typically not coincide with the YUV points of either the coarse grid or fine grid. For a truly arbitrary palette, it is possible for all 256 colors of the palette to lie within a single Y region of the YUV space.

After converting all of the palette colors to YUV space, each YUV combination of the coarse grid is then compared with all of the palette colors (using Equation (1)) to identify the palette color that most closely matches the YUV combination (step 304). A palette color is said to match a particular YUV combination most closely if the value resulting from Equation (1) is smaller than that for any other palette color.

After exhaustively searching through the palette colors for the YUV combination of the coarse grid, the closest palette color for each of the other YUV combinations of the fine grid (i.e., those with Y components that are non-integer multiples of 16) is generated by comparing the YUV combination with only a subset of palette colors (step 306). The preferred subset includes: (1) the two palette colors identified (in step 304) for the two closest coarse-grid points having the same U and V components and (2) all those palette colors identified (in step 302) as lying within the same Y region as the YUV combination. For example, when processing the YUV combination (Y1,U3,Vi) of FIG. 2, (Y1,U3,Vi) is compared to:

- the palette color identified in step 304 as being closest to the grid point (Y0,U3,Vi),
- the palette color identified in step 304 as being closest to the grid point (Y16,U3,Vi), and
- all of the palette colors identified in step 302 as falling within the Y region defined by all of the YUV combinations with Y components between Y0 and Y15 inclusive.

Step 306 is preferably implemented by processing the fine grid points sequentially along lines of fixed U and V components. For example, in FIG. 2, step 306 may sequentially process fine grid points (Y1,U3,Vi), (Y2,U3,Vi), . . . , (Y15,U3,Vi). If the distance measure $D(y,y_0)$ between YUV combination (y,u,v) and palette color $(y_0,u_0,v_0)$ is generated using Equation (1), then the distance measure $D(y+1,y_0)$ between the next YUV combination (y+1,u,v) and the same palette color $(y_0,u_0,v_0)$ may be generated using Equation (2) as follows:

$$\begin{aligned} D(y+1,y_0) &= [(y+1)-y_0]^2+[u-u_0]^2+[v-v_0]^2 \\ &= D(y,y_0)+[2(y-y_0)+1] \end{aligned} \tag{2}$$

Thus, the distance measure $D(y+1,y_0)$ for the current fine grid point may be calculated by incrementing the distance measure $D(y,y_0)$ for the previous fine grid point simply by adding the expression $2(y-y_0)+1$. Since the derivative of this expression with respect to y is 2, the distance measures for all of the points along a line of constant U and V components may be generated differentially using the following C computer language code:

```
distance[i]+=delta[i]
delta[i]+=2
```

where delta[i] is initialized to $2(y-y_0)+1$. The distance measure of Equation (1) is simply the square of the three-component distance between two signals in YUV space.

The processing of FIG. 3 may be used to generate a lookup table ClutTable that maps each of the YUV combinations of the fine grid in YUV space to the closest color in the CLUT palette. In a preferred embodiment, ClutTable is a 16K lookup table that is accessed with 14-bit indices of the form (vvvuuu 0yyyyyyy). Those skilled in the art will understand that the method of FIG. 3 greatly reduces the number of computations required to generate ClutTable compared with the exhaustive brute force method.

Video system 100 also generates lookup tables (TableU and TableV) that are used to dither the subsampled U and V signals to reconstruct video images with improved quality. Generation of the TableU and TableV lookup tables involves generating a U,V dither magnitude for the pre-defined arbitrary palette and then generating U and V bias levels. Note that Y dither magnitude is preferably not adapted to the palette, because, in the preferred conversion process described in the next section of this specification entitled "Color Conversion Processing," constant Y dither offsets are encoded into the procedure for retrieving values from Clut-Table.

Figure 4:
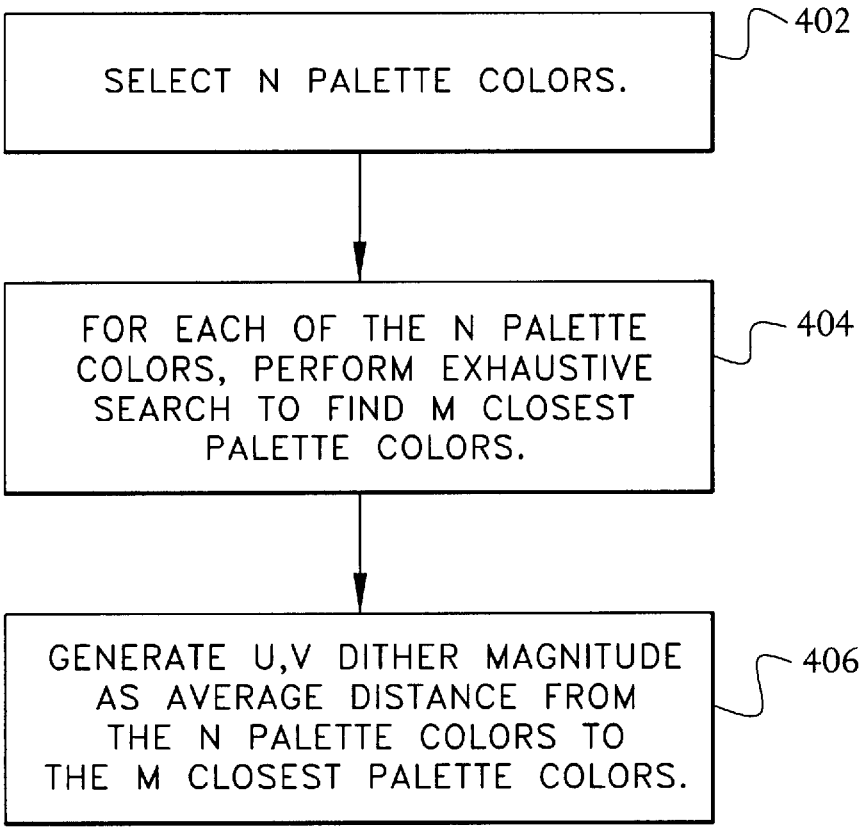
FIG. 4 is a process flow diagram of preferred processing implemented by the video system of FIG. 1 to generate the U,V dither magnitude for use in generating U and V dither lookup tables.

Referring now to FIG. 4, there is shown a process flow diagram of the processing implemented by video system 100 to generate the U,V dither magnitude for use in generating the U and V dither lookup tables, according to a preferred embodiment of the present invention. The U,V dither magnitude is preferably the average distance in YUV space between a palette color and its M closest palette neighbors, where closeness is determined using the three-component distance measure of Equation (1). The U and V dither magnitudes are preferably assumed to be identical.

To generate U and V dither magnitudes, video system 100 arbitrarily selects N of the palette colors of the CLUT (step 402 of FIG. 4). In a preferred embodiment, N is specified to be 32.

For each of the N selected palette colors, video system 100 performs an exhaustive search throughout the CLUT palette to identify the M closest palette colors (using the three-component distance measure of Equation (1)) (step 404). In a preferred embodiment, M is specified to be 6.

Video system 100 generates the U and V dither magnitude DMAG as the average distance for all of the N selected palette colors (step 406). In a preferred embodiment, the average distance is generated by summing all the square roots of the distance measures of Equation (1) from step 404 and dividing by the number of distance measures.

Figure 5:
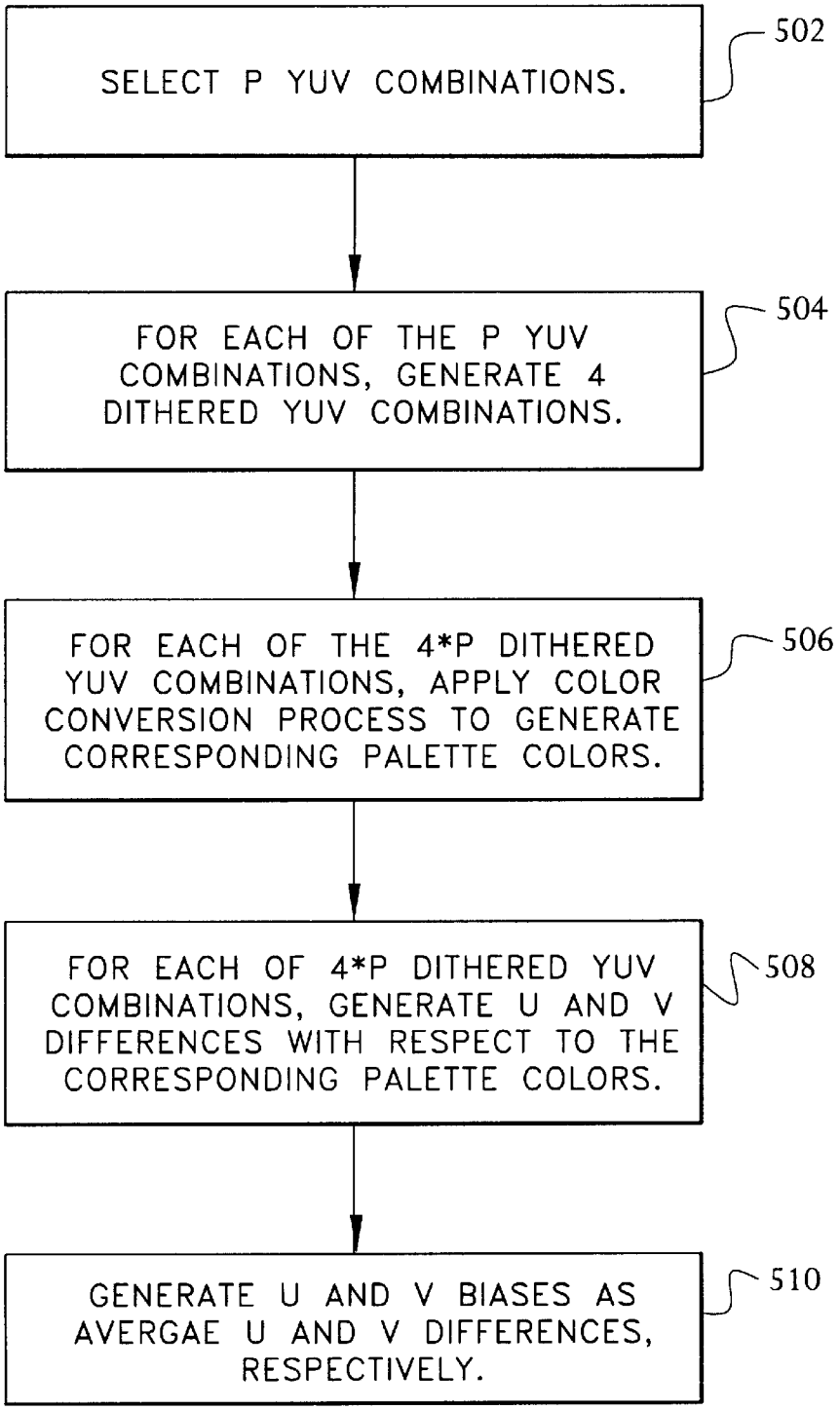
FIG. 5 is a process flow diagram of preferred processing implemented by the video system of FIG. 1 to generate the U and V biases for use in generating U and V dither lookup tables.

Referring now to FIG. 5, there is shown a process flow diagram of the processing implemented by video system 100 to generate the U and V biases for use in generating the U and V dither lookup tables, according to a preferred embodiment of the present invention. The U and V biases are preferably the average U and V errors involved in converting from a YUV combination to the CLUT palette.

To generate the U and V biases, video system 100 arbitrarily selects P YUV combinations (step 502). In a preferred embodiment, P is specified to be 128.

For each of the P selected YUV combinations, video system 100 generates (in step 504) 4 dithered $YU_jV_j$ combinations according to the following relationships:

$YU_0V_0$ where $U_0=U+2*DMAG/3$ $V_0=V+1*DMAG/3$ $YU_1V_1$ where $U_1=U+1*DMAG/3$ $V_1=V+2*DMAG/3$ $YU_2V_2$ where $U_{2=U}$ $V_2=V+DMAG$ $YU_3V_3$ where $U_3=U+DMAG$ $V_{3=V}$ For each of the 4*P selected $YU_jV_j$ combinations generated in step 504, video system 100 implements the color conversion process (described in the next section of the specification entitled "Color Conversion Processing") to generate the corresponding palette colors (step 506).

For each of the 4*P selected $YU_jV_j$ combinations generated in step 504, video system 100 generates (in step 508):

The difference between the $U_j$ component of the selected $YU_jV_j$ combination and the U component of each of the corresponding CLUT palette colors (identified in step 506), and The difference between the $V_j$ component of the selected $YU_jV_j$ combination and the V component of each of the corresponding CLUT palette colors (identified in step 506).

Video system 100 generates the U bias as the average U component difference and the V bias as the average V component difference between the 4*P selected $YU_jV_j$ combinations and the corresponding CLUT palette colors (step 510).

Video system 100 then uses the U,V dither magnitude and the U and V biases to generate the lookup tables TableU and TableV that will be used for color conversion processing. TableU and TableV are a 512-byte lookup tables. The index to TableU is a 7-bit U component and the index to TableV is a 7-bit V component. Each of the 128 entries in TableU is a 4-byte value of the form:

$$(00000u_{02}u_{01}u_{00}\ 00000u_{12}u_{11}u_{10}\ 00000u_{22}u_{21}u_{20}\ 00000u_{32}u_{31}u_{30}),$$

where:

$$u_{02}u_{01}u_{00}=(\text{CLAMP}\ [U+2*DMAG/3+UBIAS])>>4$$

$$u_{12}u_{11}u_{10}=(\text{CLAMP}\ [U+DMAG/3+UBIAS])>>4$$

$$u_{22}u_{21}u_{20}=(\text{CLAMP}\ [U+UBIAS])>>4$$

$$u_{32}u_{31}u_{30}=(\text{CLAMP}\ [U+DMAG+UBIAS])>>4$$

where U is the 7-bit U component, DMAG is the dither magnitude, and UBIAS is the U component bias. The CLAMP function is defined as follows:

$$\text{CLAMP}\ [X]=0,\ \text{IF}\ (X<0)$$

$$\text{CLAMP}\ [X]=X,\ \text{IF}\ (0<X<127)$$

$$\text{CLAMP}\ [X]=127,\ \text{IF}\ (X>127)$$

The operation ">>4" shifts the clamped signal 4 bits to the right, thereby preserving the 3 most significant bits of the 7-bit signal. Similarly, each of the 128 entries in TableV is a 4-byte value of the form:

$$(00v_{02}v_{01}v_{00}000\ 00v_{12}v_{11}v_{10}000\ 00v_{22}v_{21}v_{20}000\ 00v_{32}v_{31}v_{30}000),$$

where:

$$v_{02}v_{01}v_{00}=(\text{CLAMP}\ [V+DMAG/3+VBIAS])>>4$$

$$v_{12}v_{11}v_{10}=(\text{CLAMP}\ [V+2*DMAG/3+VBIAS])>>4$$

$$v_{22}v_{21}v_{20}=(\text{CLAMP}\ [V+DMAG+VBIAS])>>4$$

$$v_{32}v_{31}v_{30}=(\text{CLAMP}\ [V+VBIAS])>>4$$

where V is the 7-bit V component, DMAG is the dither magnitude, and VBIAS is the V component bias.

Color Conversion Processing

Figure 6:
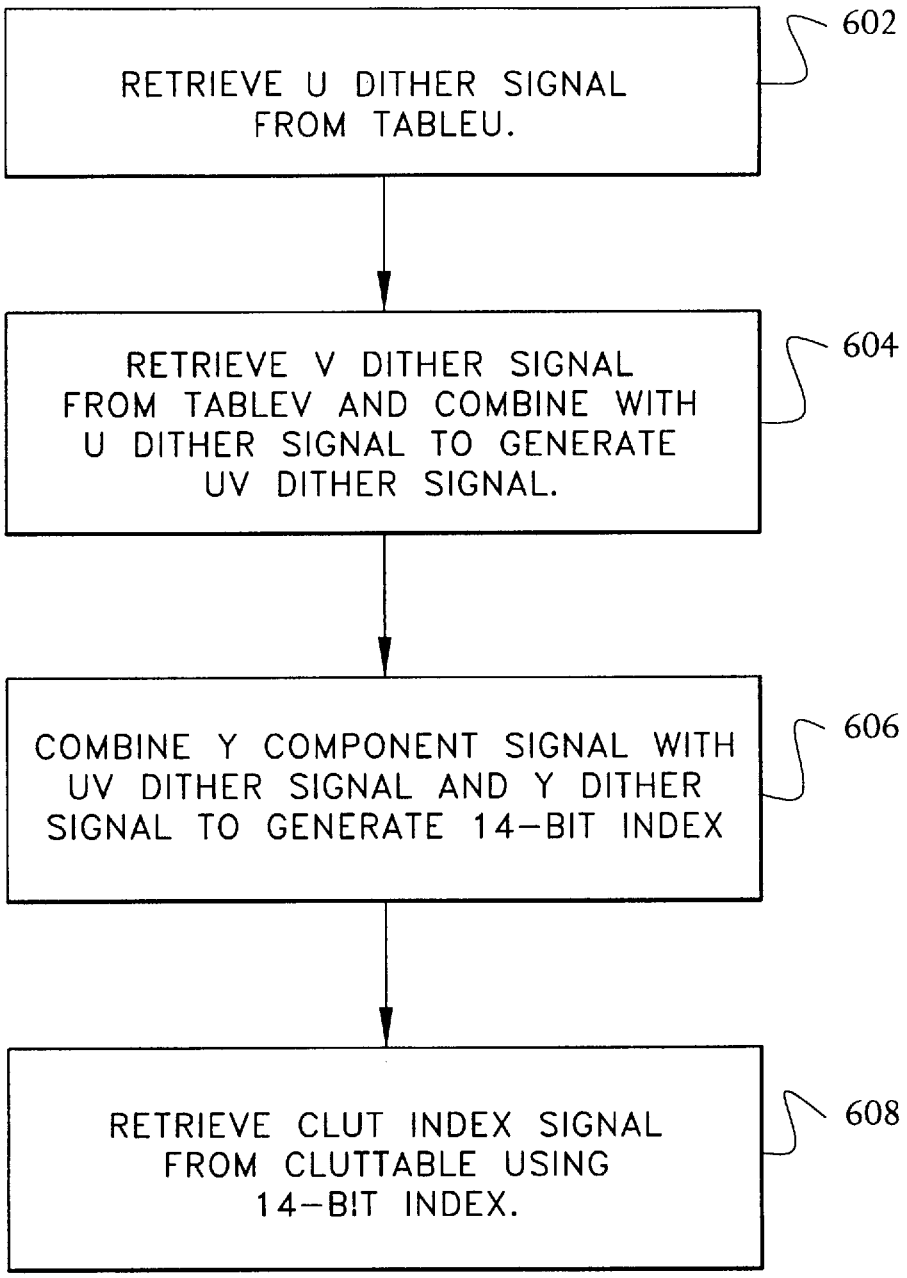
FIG. 6 shows a process flow diagram of processing implemented by the video system of FIG. 1 to convert a three-component YUV signal to a single-index CLUT signal.

Referring now to FIG. 6, there is shown a process flow diagram that represents the processing implemented by video system 100 to convert three-component YUV9 signals to single-index CLUT signals, according to a preferred embodiment of the present invention. In a preferred embodiment, the YUV9 signals comprise (4×4) blocks of pixels, wherein each pixel block comprises a corresponding (4×4) block of 7-bit Y component signals, a single 7-bit U component signal, and a single 7-bit V component signal.

The (4×4) block of Y component signals $y_{ij}$ may be represented in matrix form as follows:

$$y_{00}\ y_{01}\ y_{02}\ y_{03}$$

$$y_{10}\ y_{11}\ y_{12}\ y_{13}$$

$$y_{20}\ y_{21}\ y_{22}\ y_{23}$$

$$y_{30}\ y_{31}\ y_{32}\ y_{33}$$

Although there is a single 7-bit U component signal for all 16 pixels in the (4×4) block, the dithered U signal used to generate the CLUT index signal for a particular pixel depends upon the location of the pixel within the (4×4) block. The different dithered U signals for each (4×4) block may be represented in matrix form as follows:

$$00000u_{22}u_{21}u_{20}\ 00000u_{32}u_{31}u_{30}\ 00000u_{22}u_{21}u_{20}\ 00000u_{32}u_{31}u_{30}$$

$$00000u_{02}u_{01}u_{00}\ 00000u_{12}u_{11}u_{10}\ 00000u_{02}u_{01}u_{00}\ 00000u_{12}u_{11}u_{10}$$

$$00000u_{22}u_{21}u_{20}\ 00000u_{32}u_{31}u_{30}\ 00000u_{22}u_{21}u_{20}\ 00000u_{32}u_{31}u_{30}$$

$$00000u_{02}u_{01}u_{00}\ 00000u_{12}u_{11}u_{10}\ 00000u_{02}u_{01}u_{00}\ 00000u_{12}u_{11}u_{10}$$

where each byte is as defined in the previous section entitled "Generation of Lookup Tables."

Similarly, although there is a single 7-bit V component signal for all 16 pixels in the (4×4) block, the dithered V signal used to generate the CLUT index signal for a particular pixel depends upon the location of the pixel within the (4×4) block. The different dithered V signals for each (4×4) block may be represented in matrix form as follows:

$$00v_{22}v_{21}v_{20}000\ 00v_{32}v_{31}v_{30}000\ 00v_{22}v_{21}v_{20}000\ 00v_{32}v_{31}v_{30}000$$

$$00v_{02}v_{01}v_{00}000\ 00v_{12}v_{11}v_{10}000\ 00v_{02}v_{01}v_{00}000\ 00v_{12}v_{11}v_{10}000$$

$$00v_{22}v_{21}v_{20}000\ 00v_{32}v_{31}v_{30}000\ 00v_{22}v_{21}v_{20}000\ 00v_{32}v_{31}v_{30}000$$

$$00v_{02}v_{01}v_{00}000\ 00v_{12}v_{11}v_{10}000\ 00v_{02}v_{01}v_{00}000\ 00v_{12}v_{11}v_{10}000$$

where each byte is as defined in the previous section entitled "Generation of Lookup Tables."

In addition to dithering the U and V signals, the Y signals are also dithered. The preferred Y dither signals for each (4×4) block correspond to the following Bayer matrix:

0 4 1 5

6 2 7 3

1 5 0 4

7 3 6 2

Referring again to FIG. 6, to convert a pixel from Y, U, and V component signals to a single CLUT index signal, the U component signal may be used to generate the appropriate dithered U signal from the U dither table (TableU) (step 602 of FIG. 6). The dithered U signal may be represented as 000uuu.

The V component signal may then be used to generate the appropriate dithered V signal from the V dither table (TableV). This dithered V signal may be combined (by ORing) with the dithered U signal to generate a dithered UV signal (step 604). The dithered V signal may be represented as vvv000 and the dithered UV signal as vvvuuu.

The 7-bit Y component signal may then be combined with the dithered UV signal and the appropriate Y dither signal $Y_{dith}$ to generate a 14-bit index I (step 606). The 14-bit index I may be derived from the following relation:

$$I=(vvvuuu\ 0yyyyyyy)+(Y_{dith}*2-8)$$

where 0yyyyyyy is the Y component signal and $Y_{dith}$ is the corresponding Y dither signal (from the Y dither matrix). The $Y_{dith}$ signal is doubled and 8 is subtracted from the result so that the dithering component is balanced around 0. In a preferred embodiment, the Y component signals are constrained to levels between 8 and 120 inclusive. Since the maximum Y dither signal (in the preferred Y dither matrix described earlier in this section of the specification) is 7, the maximum dithered Y signal is 120+7*2−8=126, and the minimum dithered Y signal is 8+0*2−8=0. As a result, the dithered Y signal will always be a 7-bit signal.

The 8-bit CLUT index signal corresponding to the pixel may then be generated from the 16K CLUT conversion table (ClutTable) using the 14-bit index I (step 608). Note that since bit 7 (where bit 0 is the LSB) of the 14-bit index I is always 0, half of the 16K ClutTable is never used.

A preferred implementation of the color conversion process takes advantage of some of the symmetries and redundancies in the color conversion process. The preferred color conversion process is also designed for efficient implementation on the preferred Intel® host processors. A preferred implementation of the color conversion process of the present invention may be represented by the following C computer language code:

for each 4×4 block of YUV combinations in a frame

```
{
    // get dithered U signals for U component signal
    get U
    edx = TableU[U]
// edx now has 00000u02u01u00 00000u12u11u10 00000u22u21u20 00000u32u31u30
    // get dithered V signals for V component signal and
    // "OR" with dithered U signals
    get V
    edx |= TableV[V]
// edx now has 00v02v01v00u02u01u00 00v12v11v10u12u11u10 00v22v21v20u22u21u20
00v32v31v30u32u31u30
    // load ah and ch for rows 0 and 2
    ah = 00v32v31v30u32u31u30   // byte 3 (least significant) from edx
    ch = 00v22v21v20u22u21u20   // byte 2 from edx
    // process row 0 of (4 × 4) block from right to left
```

-continued

```
    al = y03                    // Y component for row 0 col 3
    bh = ClutTable[eax + 2]     // Y dither signal for y03 is 5
    cl = y02                    // Y component for row 0 col 2
    bl = ClutTable[ecx − 6]     // Y dither signal for y02 is 1
    shift ebx left 16 bits      // make room for next two bytes
    al = y01                    // Y component for row 0 col 1
    bh = ClutTable[eax + 0]     // Y dither signal for y01 is 4
    cl = y00                    // Y component for row 0 col 0
    bl = ClutTable[ecx − 8]     // Y dither signal for y00 is 0
    write out ebx               // from left to right across row 0
    // process row 2 of (4 × 4) block from right to left
    // retain ah and ch from row 0
    al = y23                    // Y component for row 2 col 3
    bh = ClutTable[eax + 0]     // Y dither signal for y23 is 4
    cl = y22                    // Y component for row 2 col 2
    bl = ClutTable[ecx − 8]     // Y dither signal for y22 is 0
    shift ebx left 16 bits      // make room for next two bytes
    al = y21                    // Y component for row 2 col 1
    bh = ClutTable[eax + 2]     // Y dither signal for y21 is 5
    cl = y20                    // Y component for row 2 col 0
    bl = ClutTable[ecx − 6]     // Y dither signal for y20 is 1
    write out ebx               // from left to right across row 2
    // load ah and ch for rows 1 and 3
    ah = 00v12v11v10u12u11u10   // byte 1 from edx
    ch = 00v02v01v00u02u01u00   // byte 0 (most significant) from edx
    // process row 1 of (4 × 4) block from right to left
    al = y13                    // Y component for row 1 col 3
    bh = ClutTable[eax − 2]     // Y dither signal for y13 is 3
    cl = y12                    // Y component for row 1 col 2
    bl = ClutTable[ecx + 6]     // Y dither signal for y12 is 7
    shift ebx left 16 bits      // make room for next two bytes
    al = y11                    // Y component for row 1 col 1
    bh = ClutTable[eax − 4]     // Y dither signal for y11 is 2
    cl = y10                    // Y component for row 1 col 0
    bl = ClutTable[ecx + 4]     // Y dither signal for y10 is 6
    write out ebx               // from left to right across row 1
    // process row 3 of (4 × 4) block from right to left
    // retain ah and ch from row 1
    al = y33                    // Y component for row 3 col 3
    bh = ClutTable[eax − 4]     // Y dither signal for y33 is 2
    cl = y32                    // Y component for row 3 col 2
    bl = ClutTable[ecx + 4]     // Y dither signal for y32 is 6
    shift ebx left 16 bits      // make room for next two bytes
    al = y31                    // Y component for row 3 col 1
    bh = ClutTable[eax − 2]     // Y dither signal for y31 is 3
    cl = y30                    // Y component for row 3 col 0
    bl = ClutTable[ecx + 6]     // Y dither signal for y30 is 7
    write out ebx               // from left to right across row 3
}
```

In this procedure, eax is a 4-byte register, where al is byte 3 (the lowest byte) and ah is byte 2 (the second lowest byte) in register eax. Similarly, for registers ebx and ecx.

Those skilled in the art will understand that the preferred embodiments of the generation of lookup tables and the color conversion processing described earlier in the specification are not the only embodiments that fall within the scope of the present invention. For example, alternative embodiments may generate and use lookup tables whose structure is different from those described above. In addition, alternative dithering may be applied to the Y, U, and V component signals.

Furthermore, the present invention may be used to generate and use lookup tables to convert video signals between color formats other than from YUV9 to 8-bit CLUT.

Those skilled in the art will understand that alternative embodiments of the present invention may be based on multi-media operating systems other than Microsoft® Video for Windows and Apple® QuickTime and/or in PC environments based on processors other than Intel® x86 or Motorola® microprocessors. It will also be understood by those skilled in the art that the present invention may be used to convert signals corresponding to images other than video images.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A computer-implemented process for displaying an image in a system having a CLUT palette, wherein the CLUT palette maps each CLUT signal $C_h$ of a plurality of CLUT signals C to a corresponding display signal $d_h$ of a plurality of display signals D, comprising the steps of:

(a) receiving an arbitrary CLUT palette defined by an application while the application is running on the system;

(b) generating a color conversion table for the CLUT palette while the application is running on the system, wherein the color conversion table maps each image signal $S_i$ of a plurality of image signals S to a corresponding CLUT signal $C_i$ of the plurality of CLUT signals C;

(c) providing an image signal $S_j$ corresponding to an image;

(d) Transforming the image signal $S_j$ to a CLUT signal $C_j$ of the plurality of CLUT signals C using the color conversion table; and (e) displaying the image in accordance with the CLUT signal $C_j$, wherein the CLUT signal $C_j$ is transformed to a display signal $d_j$ of the plurality of display signals D using the CLUT palette.

2. The process of claim 1, wherein step (b) comprises the steps of:

(1) selecting an image signal $S_k$ of the plurality of image signals S;

(2) determining a CLUT signal $C_k$ of the plurality of CLUT signals C that corresponds with the image signal $S_k$; and (3) generating a portion of the color conversion table in accordance with image signal $S_k$ and CLUT signal $C_k$.

3. The process of claim 1, wherein:

the plurality of image signals S are three-component image signals;

the plurality of CLUT signals C are one-component image signals; and the plurality of display signals D are three-component image signals.

4. The process of claim 1, wherein step (b) comprises the steps of:

(1) selecting a CLUT signal $C_1$ of the plurality of CLUT signals C;

(2) transforming the CLUT signal $C_1$ to a corresponding image signal $S_1$;

(3) repeating steps (b)(1) and (b)(2) for each CLUT signal $C_1$ of the plurality of CLUT signals C to generate a plurality of image signals $S_1$;

(4) selecting a coarse-grid image signal $S_c$ of a plurality of coarse-grid image signals $S_c$, wherein the plurality of image signals S comprises the plurality of coarse-grid image signals $S_c$;

(5) determining a CLUT signal $C_c$ of the plurality of CLUT signals C that best matches the coarse-grid image signal $S_c$ by performing an exhaustive comparison between coarse-grid image signal $S_c$ and the plurality of image signals $S_1$;

(6) generating a portion of the color conversion table in accordance with the coarse-grid image signal $S_c$ and the CLUT signal $C_c$;

(7) repeating steps (b)(4) through (b)(6) for each coarse-grid image signal $S_c$ of the plurality of coarse-grid image signals $S_c$;

(8) selecting a CLUT signal $S_f$ of a plurality of fine-grid image signals $S_f$, wherein the plurality of image signals S comprises the plurality of fine-grid image signals $S_f$;

(9) determining a CLUT signal $C_f$ of the plurality of CLUT signals C that best matches the fine-grid image signal $S_f$ by performing a non-exhaustive comparison between fine-grid image signal $S_f$ and the plurality of image signals $S_1$;

(10) generating an additional portion of the color conversion table in accordance with the coarse-grid image signal $S_c$ and the CLUT signal $C_c$; and

(11) repeating steps (b)(7) through (b)(10) for each fine-grid image signal $S_f$ of the plurality of fine-grid image signals $S_f$.

5. The process of claim 1, wherein step (b) comprises the step of generating the color conversion table while the application is running, in a sufficiently short period of time so as to avoid significant delay in displaying video images.

6. The process of claim 1, further comprising the steps of:

(f) receiving a changed CLUT palette while the application is running; and (g) generating at least one new color conversion table for the changed CLUT palette while the application is running in a sufficiently short period of time so as to avoid significant delay in displaying images.

7. The process of claim 1, wherein:

step (b) further comprises the steps of:

(1) generating a U dither table for dithering U component signals in accordance with the CLUT palette; and (2) generating a V dither table for dithering V component signals in accordance with the CLUT palette; and step (d) comprises the step of transforming the image signal $S_j$ to the CLUT signal $C_j$ using the color conversion table, the U dither table, and the V dither table.

8. The process of claim 7, wherein:

step (b) further comprises the steps of:

(3) generating the U and V dither magnitudes for the CLUT palette; and (4) generating the U and V biases for the color conversion table;

step (b)(1) comprises the step of generating the U dither table in accordance with the U dither magnitude and the U bias; and step (b)(2) comprises the step of generating the V dither table in accordance with the V dither magnitude and the V bias.

9. The process of claim 8, wherein step ([a] b)(3) comprises the steps of:

i) selecting N palette colors of the CLUT palette;

ii) performing an exhaustive search for the M closest palette colors of the CLUT palette for each of the N palette colors and iii) generating the U and V dither magnitudes from the average distance from each of the N palette colors to each of the M closest palette colors.

10. The process of claim 8, wherein step ([a] b)(4) comprises the steps of:

i) selecting P YUV combinations of the plurality of image signals S;

ii) generating Q dithered YUV combinations for each of the P YUV combinations;

iii) color converting each of the Q*P dithered YUV combinations to generate one or more corresponding palette colors;

iv) generating U and V differences between each of the Q*P dithered YUV combinations and the one or more corresponding palette colors;

v) generating the U bias from the average U difference; and vi) generating the V bias from the average V difference.

11. The process of claim 7, wherein step (d) comprises the steps of:

(1) converting a U component signal of the image signal $s_j$ to a U dither signal using the U dither table:

(2) converting a V component signal of the image signal $s_j$ to a V dither signal using the V dither table;

(3) combining the U dither signal and the V dither signal with a Y component signal of the image signal $s_j$ and a Y dither signal to generate an index signal; and (4) transforming the image signal $s_j$ to the CLUT signal $c_j$ by accessing the color conversion table using the index signal.

12. An apparatus for displaying an image in a computer system having a CLUT palette, wherein the CLUT palette maps each CLUT signal $C_h$ of a plurality of CLUT signals C to a corresponding display signal $d_h$ of a plurality of display signals D, comprising:

(a) means, responsive to an application running on the computer system which defines the CLUT palette while the application is running, for generating a color conversion table for the CLUT palette while the application is running, wherein the color conversion table maps each image signal $s_i$ of a plurality of image signals S to a corresponding CLUT signal $c_i$ of a plurality of CLUT signals C;

(b) means for providing an image signal $s_j$ corresponding to an image;

(c) means for transforming the image signal $s_j$ to a CLUT signal $c_j$ of the plurality of CLUT signals C using the color conversion table; and (d) means for displaying the image in accordance with the CLUT signal $c_j$, wherein the CLUT signal $C_j$ is transformed to a display signal $d_j$ of the plurality of display signals D using the CLUT palette.

13. The apparatus of claim 12, wherein means (a) comprises:

(1) means for selecting an image signal $s_k$ of the plurality of image signals S;

(2) means for determining a CLUT signal $c_k$ of the plurality of CLUT signals C that corresponds with the image signal $s_k$; and (3) means for generating a portion of the color conversion table in accordance with image signal $s_k$ and CLUT signal $c_k$.

14. The apparatus of claim 12, wherein:

the plurality of image signals S are three-component image signals;

the plurality of CLUT signals C are one-component image signals; and the plurality of display signals D are three-component image signals.

15. The apparatus of claim 12, wherein means (a) comprises:

(1) means for selecting a CLUT signal $c_1$ of the plurality of CLUT signals C;

(2) means for transforming the CLUT signal $c_1$ to a corresponding image signal $s_1$;

(3) means for repeating the processing of means (a)(1) and (a)(2) for each CLUT signal $c_1$ of the plurality of CLUT signals C to generate a plurality of image signals $S_1$;

(4) means for selecting a coarse-grid image signal $s_c$ of a plurality of coarse-grid image signals $S_c$, wherein the plurality of image signals S comprises the plurality of coarse-grid image signals $S_c$;

(5) means for determining a CLUT signal $c_c$ of the plurality of CLUT signals C that best matches the coarse-grid image signal $s_c$ by performing an exhaustive comparison between coarse-grid image signal $s_c$ and the plurality of image signals $S_1$;

(6) means for generating a portion of the color conversion table in accordance with the coarse-grid image signal $s_c$ and the CLUT signal c;

(7) means for repeating the processing of means (a)(4) through (a)(6) for each coarse-grid image signal $s_c$ of the plurality of coarse-grid image signals $S_c$;

(8) means for selecting a fine-grid image signal $s_f$ of a plurality of fine-grid image signals $S_f$, wherein the plurality of image signals S comprises the plurality of fine-grid image signals $S_f$;

(9) means for determining a CLUT signal $c_f$ of the plurality of CLUT signals C that best matches the fine-grid image signal $s_f$ by performing a non-exhaustive comparison between fine-grid image signal $s_f$ and the plurality of image signals $S_1$;

(10) means for generating an additional portion of the color conversion table in accordance with the coarse-grid image signal $s_c$ and the CLUT signal $c_c$; and

(11) means for repeating the processing of means (a)(7) through (a)(10) for each fine-grid image signal $s_f$ of the plurality of fine-grid image signals $S_f$.

16. The apparatus of claim 12, wherein means (a) comprises means for generating the color conversion table while the application is running, in a sufficiently short period of time so as to avoid significant delay in displaying video images.

17. The apparatus of claim 12, further comprising;

(e) means for receiving a changed CLUT palette while the application is running; and (f) means for generating at least one new color conversion table for the changed CLUT palette while the application is running, in a sufficiently short period of time so as to avoid significant delay in displaying video images.

18. The apparatus of claim 12, wherein:

means (a) further comprises:

(1) means for generating a U dither table for dithering U component signals in accordance with the CLUT palette; and (2) means for generating a V dither table for dithering V component signals in accordance with the CLUT palette; and means (c) comprises means for transforming the image signal $s_j$ to the CLUT signal $c_j$ using the color conversion table, the U dither table, and the V dither table.

19. The apparatus of claim 18, wherein:

means (a) further comprises:

(3) means for generating the U and V dither magnitudes for the CLUT palette; and (4) means for generating the U and V biases for the color conversion table;

means (a)(1) comprises means for generating the U dither table in accordance with the U dither magnitude and the U bias; and means (a)(2) comprises means for generating the V dither table in accordance with the V dither magnitude and the V bias.

20. The apparatus of claim 19, wherein means (a)(3) comprises:

i) means for selecting N palette colors of the CLUT palette;

ii) means for performing an exhaustive search for the M closest palette colors of the CLUT palette for each of the N palette colors; and iii) means for generating the U and V dither magnitudes from the average distance from each of the N palette colors to each of the M closest palette colors.

21. The apparatus of claim 19, wherein means (a)(4) comprises:

i) means for selecting P YUV combinations of the plurality of image signals S;

ii) means for generating Q dithered YUV combinations for each of the P YUV combinations;

iii) means for color converting each of the Q*P dithered YUV combinations to generate one or more corresponding palette colors;

iv) means for generating U and V differences between each of the Q*P dithered YUV combinations and the one or more corresponding palette colors;

v) means for generating the U bias from the average U difference; and vi) means for generating the V bias from the average V difference.

22. The apparatus of claim 18, wherein means (c) comprises:

(1) means for converting a U component signal of the image signal $s_j$ to a U dither signal using the U dither table;

(2) means for converting a V component signal of the image signal $s_j$ to a V dither signal using the V dither table;

(3) means for combining the U dither signal and the V dither signal with a Y component signal of the image signal $s_j$ and a Y dither signal to generate an index signal; and (4) means for transforming the image signal $s_j$ to the CLUT signal $c_j$ by accessing the color conversion table using the index signal.

23. A computer system for displaying an image, the computer system having an application and a CLUT palette, wherein the CLUT palette maps each CLUT signal $c_h$ of a plurality of CLUT signals C to a corresponding display signal $d_h$ of a plurality of display signals D, comprising:

(a) a host processor;

(b) a color converter adapted for implementation in the host processor; and (c) a display monitor, wherein:

the application is capable of defining the CLUT palette while the application is running on the computer system;

the color converter is capable of generating a color conversion table for the CLUT palette while the application is running on the computer system, wherein the color conversion table maps each image signal $S_i$ of a plurality of image signals S to a corresponding CLUT signal $c_i$ of the plurality of CLUT signals C;

the host processor is capable of providing an image signal $s_j$ to a CLUT signal $c_j$ of the plurality of CLUT signals C using the color conversion table; and the display monitor is capable of displaying the image in accordance with the CLUT signal $c_j$, wherein the CLUT signal $c_j$ is capable of being transformed to a display signal $d_j$ of the plurality of display signals D using the CLUT palette.

24. The system of claim 23, wherein the color converter is capable of:

(1) selecting an image signal $s_k$ of the plurality of image signals S;

(2) determining a CLUT signal $c_k$ of the plurality of CLUT signals C that corresponds with the image signal $s_k$; and (3) generating a portion of the color conversion table in accordance with image signal $s^k$ and CLUT signal $c_k$.

25. The system of claim 23, wherein the color converter is capable of:

(1) selecting a CLUT signal $c_l$ of the plurality of CLUT signals C;

(2) transforming the CLUT signal $c_1$ to a corresponding image signal $s_1$ of a plurality of image signals $S_1$;

(3) selecting a coarse-grid image signal $s_c$ of a plurality of coarse-grid image signals $S_c$, wherein the plurality of image signals S comprises the plurality of coarse-grid image signals $S_c$;

(4) determining a CLUT signal $c_c$ of the plurality of CLUT signals C that best matches the coarse-grid image signal $s_c$ by performing an exhaustive comparison between coarse-grid image signal $s_c$ and the plurality of image signals $S_i$;

(5) generating a portion of the color conversion table in accordance with the coarse-grid image signal $s_c$ and the CLUT signal $c_c$;

(6) selecting a fine-grid image signal $s_f$ of a plurality of fine-grid image signals $S_f$, wherein the plurality of image signals S comprises the plurality of fine-grid image signals $S_f$;

(7) determining a CLUT signal $c_f$ of the plurality of CLUT signals C that best matches the fine-grid image signal $s_f$ by performing a non-exhaustive comparison between fine-grid image signal $s_f$ and the plurality of image signals $S_i$; and (8) generating an additional portion of the color conversion table in accordance with the coarse-grid image signal $s_c$ and the CLUT signal $c_c$.

26. The system of claim 23, wherein the color converter is capable of generating the color conversion table while the application is running, in a sufficiently short period of time so as to avoid significant delay in displaying video images.

27. The system of claim 23, wherein the color converter is capable of receiving a changed CLUT palette while the application is running, and is capable of generating at least one new color conversion table for the changed CLUT palette while the application is running in a sufficiently short period of time so as to avoid significant delay in displaying video images.

28. The system of claim 23, wherein the color converter is capable of:

generating a U dither table for dithering U component signals in accordance with the CLUT palette;

generating a V dither table for dithering V component signals in accordance with the CLUT palette; and transforming the image signal $s_j$ to the CLUT signal $c_j$ using the color conversion table, the U dither table, and the V dither table.

29. The system of claim 28, wherein the color converter is capable of:

generating the U and V dither magnitudes for the CLUT palette;

generating the U and V biases for the color conversion table;

generating the U dither table in accordance with the U dither magnitude and the U bias; and generating the V dither table in accordance with the V dither magnitude and the V bias.

30. The system of claim 29, wherein the color converter is capable of:

selecting N palette colors of the CLUT palette;

performing an exhaustive search for the M closest palette colors of the CLUT palette for each of the N palette colors; and generating the U and V dither magnitudes from the average distance from each of the N palette colors to each of the M closest palette colors.

31. The system of claim 29, wherein the color converter is capable of:

selecting P YUV combinations of the plurality of image signals S;

generating Q dithered YUV combinations for each of the P YUV combinations;

color converting each of the Q*P dithered YUV combinations to generate one or more corresponding palette colors;

generating U and V differences between each of the Q*P dithered YUV combinations and the one or more corresponding palette colors;

generating the U bias from the average U difference; and generating the V bias from the average V difference.

32. The system of claim 28, wherein the color converter is capable of:

converting a U component signal of the image signal $s_j$ to a U dither signal using the U dither table;

converting a V component signal of the image signal $s_j$ to a V dither signal using the V dither table;

combining the U dither signal and the V dither signal with a Y component signal of the image signal $s_j$ and a Y dither signal to generate an index signal; and transforming the image signal $s_j$ to the CLUT signal $C_j$ by accessing the color conversion table using the index signal.

33. A computer-implemented process for generating a color conversion table for an arbitrary CLUT palette, wherein the color conversion table maps each image signal $S_i$ of a plurality of image signals to a corresponding CLUT signal $C_i$ of a plurality of CLUT signals C, comprising the steps of:

(a) receiving a CLUT palette;

(b) transforming each of the plurality of CLUT signals C to a corresponding one of the plurality of image signals $S_i$;

(c) selecting a coarse grid comprising a subset $S_c$ of the plurality of image signals;

(d) matching each respective image signal $S_c$ in the coarse grid to a corresponding closest one of the plurality of CLUT signals C;

(e) selecting a fine grid $S_f$ comprising all of the plurality of image signals $S_i$;

(f) matching each respective image signal $S_f$ in the fine grid but not in the coarse grid $S_c$ to a corresponding closest one of a proper subset of the plurality of CLUT signals C, thereby to form the color conversion table.

34. A process according to claim 33, wherein the proper subset of the plurality of CLUT signals includes two CLUT signals $C_1$ and $C_2$, which correspond to image signals $S_c$ of the coarse grid which most closely match the image signal $S_f$ and any other image signal having a Y component within a range defined by a Y component corresponding to CLUT signal $C_1$ and a Y component corresponding to CLUT signal $C_2$.

35. A system for generating a color conversion table for an arbitrary CLUT palette, wherein the color conversion table maps each image signal $S_i$ of a plurality of image signals to a corresponding CLUT signal $C_i$ of a plurality of CLUT signals C, comprising a processor capable of:

(a) receiving a CLUT palette;

(b) transforming each of the plurality of CLUT signals C to a corresponding one of the plurality of image signals $S_i$;

(c) selecting a coarse grid comprising a subset $S_c$ of the plurality of image signals;

(d) matching each respective image signal $S_c$ in the coarse grid to a corresponding closest one of the plurality of CLUT signals C;

(e) selecting a fine grid $S_f$ comprising all of the plurality of image signals $S_i$;

(f) matching each respective image signal $S_f$ in the fine grid but not in the coarse grid $S_c$ to a corresponding closest one of a proper subset of the plurality of CLUT signals C, thereby to form the color conversion table.

36. A system according to claim 35, wherein the proper subset of the plurality of CLUT signals includes two CLUT signals $C_1$ and $C_2$, which correspond to image signals $S_c$ of the coarse grid which most closely match the image signal $S_f$ and any other image signal having a Y component within a range defined by a Y component corresponding to CLUT signal $C_1$ and a Y component corresponding to CLUT signal $C_2$.

* * * * *

UNITED STATES PATENT AND TRADEMARK OFFICE

CERTIFICATE OF CORRECTION

| | | |
|---|---|---|
| PATENT NO. | : | 5,877,754 |
| DATED | : | March 2, 1999 |
| INVENTOR(S) | : | Michael Keith and Stephen Wood |

It is certified that error appears in the above-identified patent and that said Letters Patent is hereby corrected as shown below:

Column 15, line 3, delete "$C_h$" and insert therefor --$c_h$--.

Column 15, line 64, delete "signal c" and insert therefor --signal $c_c$--

Column 17, Line 49, after $s_j$ insert
--corresponding to an image;
the color converter is capable of transforming the image signal $s_j$--.

Column 17, line 65, delete "$s^k$" and insert therefor --$s_k$--

Signed and Sealed this

Ninth Day of November, 1999

*Attest:*

*Attesting Officer*

Q. TODD DICKINSON

*Acting Commissioner of Patents and Trademarks*